United States Patent [19]

Schmidt et al.

[11] Patent Number: 4,766,437

[45] Date of Patent: Aug. 23, 1988

[54] ANTENNA APPARATUS HAVING MEANS FOR CHANGING THE ANTENNA RADIATION PATTERN

[75] Inventors: Charles J. Schmidt, Riverdale, N.J.; Victor J. Albanese, Valley Stream, N.Y.

[73] Assignee: Grumman Aerospace Corporation, Bethpage, N.Y.

[21] Appl. No.: 2,060

[22] Filed: Jan. 9, 1987

Related U.S. Application Data

[63] Continuation-in-part of Ser. No. 457,414, Jan. 12, 1983, abandoned.

[51] Int. Cl.[4] ..... H01Q 3/22; H01Q 3/24; H01Q 3/26

[52] U.S. Cl. ..... 342/368

[58] Field of Search ..... 342/368, 371, 372, 373, 342/374, 375; 455/78, 83

[56] References Cited

U.S. PATENT DOCUMENTS

| | | | |
|---|---|---|---|
| 2,419,562 | 4/1947 | Kandoian . | |
| 2,848,714 | 8/1958 | Ring . | |
| 2,991,471 | 7/1961 | Pritchard . | |
| 3,029,432 | 4/1962 | Hansen . | |
| 3,056,961 | 10/1962 | Mitchell . | |
| 3,093,826 | 11/1963 | Fink . | |
| 3,144,648 | 8/1964 | Dollinger . | |
| 3,176,297 | 3/1965 | Forsberg . | |
| 3,258,774 | 6/1966 | Kinsey . | |
| 3,319,249 | 5/1967 | Blanchier et al. . | |
| 3,355,735 | 11/1967 | Chait . | |
| 3,380,052 | 4/1968 | Drabowitch et al. . | |
| 3,380,053 | 4/1968 | Connolly . | |
| 3,569,976 | 3/1971 | Korvin et al. . | |
| 3,922,685 | 11/1975 | Opas | 342/372 |
| 3,945,009 | 3/1976 | Trigon . | |
| 4,101,902 | 7/1978 | Trigon | 342/374 |
| 4,107,678 | 8/1978 | Powell . | |
| 4,146,889 | 3/1979 | Brennan et al. | 342/370 |

OTHER PUBLICATIONS

H. Malone, High Power Pin Diode Matrix, Motorola Inc., pp. 173–175.

*Primary Examiner*—Theodore M. Blum

*Attorney, Agent, or Firm*—Richard G. Geib; Daniel J. Tick; Bernard S. Hoffman

[57] ABSTRACT

Antenna apparatus for changing the antenna radiation pattern includes a transmitter and first and second antenna members. Each antenna member has a plurality of antenna elements which are arranged such that the elements of each antenna member are exponentially amplitude fed. A directional coupler responsive to the transmitter divides the power from the transmitter between the first and second antenna members such that each antenna member is provided with a signal of equal amplitude and phase. A variable phase shifter connected between the directional coupler and one of the antenna members is selectively operable either at 0°, or at a predetermined value in the range of about 60° to 120°. A symmetrical pencil beam pattern is provided when the variable phase shifter is set at 0°, and a cosecant squared pattern is provided when the variable phase shifter is set at a value in the range of about 60° to 120°. Switches are included to provide sum and difference monopulse and interferometry outputs.

12 Claims, 4 Drawing Sheets

ANTENNA APPARATUS HAVING MEANS FOR CHANGING THE ANTENNA RADIATION PATTERN

BACKGROUND OF THE INVENTION

This is a Continuation-in-Part of application Ser. No. 457,414, filed Jan. 12, 1983 by the same inventors, and now abandoned.

1. Field of the Invention

The present invention relates to an antenna apparatus having means for changing the antenna radiation pattern. More particularly, the invention relates to an antenna apparatus having means for changing the antenna radiation pattern from symmetrical to cosecant squared, interferometric or monopulse patterns without changing the physical configuration of the apparatus.

2. The Prior Art

In certain applications, it is desirable to change the configuration of a radar or intercept receiver search antenna pattern from a symmetrical shape to a cosecant squared shape for different operational purposes. Such applications include airborne radar scanning ground targets as well as ground based antennas searching for airborne targets. For example, in certain applications, it may be desirable to obtain the maximum gain from an antenna of a given aperture rather than optimum coverage. In such a situation, a symmetrical fan beam pattern would be preferable to a cosecant squared pattern insofar as it provides approximately 2 dB more gain than the cosecant squared pattern.

In other applications, it may be required to use the antenna in one mode on transmit and in another mode on receive. For example, it may be desirable to transmit on a cosecant squared pattern and to receive with a symmetrical beam. Alternatively, it may be desirable to receive in an interferometer or monopulse mode for tracking purposes.

As is known, the cosecant squared pattern is one in which the signal power pattern in the vertical plane varies as the square of the cosecant of the elevation angle. The cosecant squared radar beam provides a fixed signal return from a constant cross-section target, regardless of the range of the target when the pattern is optimized for a given height.

One method for forming a cosecant squared pattern is by feeding a series of slots or horns with an exponential amplitude excitation and uniformly progressing the phase of the slots or horns or providing the slots or horns with equal phase referenced to the feed end.

Another method for providing a cosecant squared pattern is by directing the output energy of a small primary antenna such as a feed horn into a parabolic shaped reflector. The primary antenna is situated at the focal point of the parabolic shaped reflector, and one section of the reflector deviates from the parabolic configuration so as to "spoil" or smear the energy into a broader pattern of cosecant squared shape. To effect pattern changing, the "spoiler" section of the reflector may be mechanically moved into the main reflector body so as to restore, in effect, a full parabolic reflector which will form a symmetrical pencil beam when desired. Although this method of switching from a cosecant squared pattern to a symmetrical pencil beam pattern, and vice versa, is effective, it is both cumbersome and slow because mechanical motion is required. This shortcoming makes such a mechanical method inapplicable for applications that require rapid (microseconds) pattern changes.

Accordingly, it is an object of this invention to provide antenna apparatus for changing the antenn radiation pattern rapidly from symmetrical, to cosecant squared, to interferometric, or to monopulse, as the application requires.

It is another object of the invention to provide antenna apparatus having the above characteristics which does not require changing the physical configuration of the antenna apparatus, but simply involves switching phase shifters in and out of the RF, and in some cases the IF portion of the antenna system.

BRIEF SUMMARY OF THE INVENTION

In accordance with the above objectives, the present invention provides antenna apparatus having means for rapidly changing the antenna radiation pattern. In a radar application, the subject apparatus includes a transmitter and first and second contiguous antenna members, each of which, has a plurality of antenna elements. Preferably, each antenna member is either a linear array waveguide of series fed or corporately fed slots, dipoles or horns, or a full two-dimensional planar array of slots, dipoles or horns. Each antenna member includes feed means such that each antenna element is exponentially amplitude fed.

If an array of N antenna elements are fed with voltage amplitudes, Vn, then the feed is exponential if $$Vn = k_1 \times (\text{a Base Number})^{exponent}$$

where n is an element in the array and $1 \leqq n \leqq N$ and the $$\text{exponent equals } -k_2 \frac{(n-1)}{(N-1)}$$

where $k_1$ is a normalizing factor and k represents the "pedestal"; that is, it sets the voltage amplitude on the last element N. The base number sets the rate of the exponential "decay" or the feed. For the example hereinafter described, a base number of 10 was chosen, so that $$Vn = k_1 \, 10^{-k_2 \frac{(n-1)}{(N-1)}}$$

The term "exponentially amplitude fed" is well known to anyone ordinarily skilled in the art. Therefore, the phrase itself is sufficient to convey its full meaning, and it can be considered redundant and optional to include the mathematical definition submitted by applicants by amendment.

An exponentially fed antenna can be provided by feeding each element of the antenna from a series tap on a transmission line with equal couplers. Thus, for example, if 100 watts is fed into the feed line and the first coupler taps off 10%, the power to the first element is 10 watts, the power to the second element is 10% of the remainder (90 watts) or 9 watts, the power to the third element is 10% of 81 watts or 8.1 watts, the power to the fourth element is 10% of 72.9 watts or 7.29 watts. This process is repeated for each successive element and the result is called an exponential taper or an exponentially fed antenna.

Besides the foregoing mathematical definition of an exponentially fed antenna, it is well known that an exponentially fed antenna is only one of many available methods for feeding an antenna array. Other methods are uniform, cosine, cosine squared, cosine on a pedestal, etc. Each results in a different radiation pattern which may be selected for specific applications.

A first directional coupler is responsive to the transmitter for dividing the transmitted power between the first and second antenna members such that the antenna members are in phase with one another, with each antenna element in each antenna also being in phase with one another. Preferably, the directional coupler is a 3-dB hybrid junction or power divider. A first duplexer is connected between the first antenna member and the first directional coupler. A second duplexer is connected between the second antenna member and a first variable phase shifter, the variable phase shifter being connected between the first directional coupler and the second duplexer. The variable phase shifter, preferably a variable radio frequency phase shifter, is operable either at 0° or nominally 90°, for example, 90°±30°.

The subject apparatus further includes a local oscillator and a first mixer responsive to the first duplexer and the local oscillator for providing an output proportional to the received signals provided from the first duplexer and the oscillator. A second mixer is responsive to the second duplexer and the local oscillator for providing an output proportional to the received signals provided from the second duplexer and the local oscillator. The two mixer outputs are intermediate frequencies typically in the order of about 30 to 60 mHz. A second variable phase shifter, preferably a low power intermediate frequency phase shifter, is responsive to the signals provided by the second mixer.

The apparatus further includes a second directional coupler, preferably a low power intermediate frequency 3-dB hybrid junction, and first and second receivers selectively connectable to the second directional coupler. The second directional coupler includes a pair of input ports and a pair of output ports, one output port being a "summation" port, the other output port being a "difference" port. A first pair of switches selectively connects the output of the first mixer either to the first receiver directly, when the switches are in a first position, or to the second directional coupler, when the switches are in a second position. In the latter case, the output of the first mixer is connected to one of the input ports of the second directional coupler, and the difference output port of the directional coupler is connected to the first receiver.

A second pair of switches selectively connects the output of the second phase shifter either to the second receiver directly, when the switches are in a first position, or to the second directional coupler when the switches are in a second position. In the latter case, the output of the second phase shifter is connected to one of the input ports of the second directional coupler, and the "summation" output port of the second directional coupler is connected to the second receiver.

In operation, when the apparatus is in the transmit mode, the combined pattern radiated by the antenna members is a symmetrical pencil beam pattern, when the first phase shifter is set at 0°, and a cosecant squared pattern, when the first phase shifter is set at nominally 90°, for example, 90°±30°. When the apparatus is in the receiver mode, and the two pairs of switches are in the first position and the second phase shifter is set at 0°, the receivers provide an interferometry pattern. When the switches are in the second position and the second phase shifter is set at 0°, a monopulse difference pattern appears at the receiver connected to the "difference" output port of the second directional coupler, and a symmetrical pencil beam appears at the receiver connected to the "summation" output port of the second directional coupler.

In an alternate embodiment of the invention, the antenna apparatus includes a transmitter, a pair of antenna members, and a first directional coupler responsive to the transmitter for dividing the power from the transmitter between the two antennas. A first duplexer is connected between one antenna and the first directional coupler. A second duplexer is connected to the other antenna and also to a first variable phase shifter. This phase shifter, which is also connected to the first directional coupler is operable either at 0° or nominally 90°, for example, 90°±30°.

A second variable phase shifter is connected to the second duplexer and is also operable either at 0°, or at nominally 90°, for example, 90°±30°.

The apparatus of the invention further includes a second directional coupler, preferably a radio frequency 3-dB hybrid junction, and first and second receivers. The second directional coupler includes a pair of input ports and a pair of output ports, one output port being a "summation" port, the other output port being a "difference" port. A first pair of switches selectively connects the output of the first duplexer either to the first receiver directly, when the switches are in a first position, or to the second directional coupler, when the switches are in a second position. In the latter case, the output of the first duplexer is connected to one of the input ports of the second directional coupler, and the "difference" output port of the directional coupler is connected to the first receiver.

A second pair of switches selectively connects the output of the second phase shifter either to the second receiver directly, when the switches are in a first position, or to the second directional coupler, when the switches are in a second position. In the latter case, the output of the second phase shifter is connected to one of the input ports of the second directional coupler, and the "summation" output port of the second directional coupler is connected to the second receiver.

In operation, when the apparatus is in the transmit mode, the combined pattern radiated by the antenna members is a symmetrical pencil beam pattern, when the first phase shifter is set at 0°, and cosecant squared pattern, when the first phase shifter is set at nominally 90°, for example, 90°±30°. When the apparatus is in the receive mode, and the two pairs of switches are in the first position and the second phase shifter is set at 0°, the receivers provide an interferometry pattern. When the switches are in the second position and the second phase shifter is set at 0°, a monopulse difference pattern appears at the receiver connected to the "difference" output port of the second directional coupler, and a symmetrical pencil beam appears at the receiver connected to the "summation" output port of the second directional coupler.

When the switches are in the second position and the second phase shifter is set at nominally 90°, for example, 90°±30°, a cosecant squared pattern appears at the receiver connected to the "summation" output port of the second directional coupler.

BRIEF DESCRIPTION OF THE DRAWINGS

In order that the invention may be readily carried into effect, it will now be described with reference to the accompanying drawings, wherein.

DETAILED DESCRIPTION OF THE PREFERRED EMBODIMENTS

Figure 1:
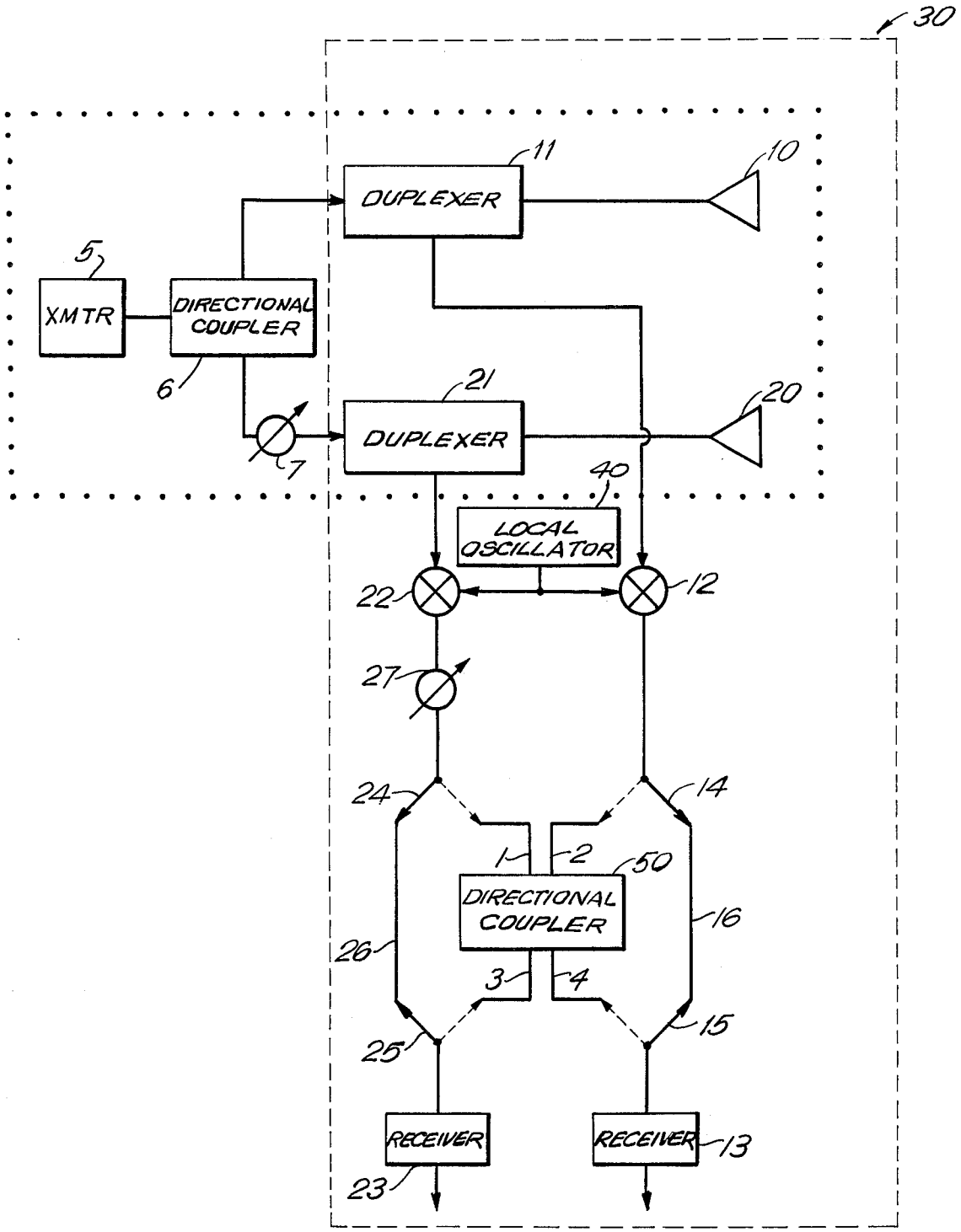
FIG. 1 is a schematic diagram of the preferred embodiment of the antenna apparatus of the invention.

FIG. 1 is a schematic diagram of the antenna apparatus of the invention, designated generally by reference numeral 30. As shown, the apparatus 30 includes two contiguous antenna members 10 and 20 arranged to form a single array wherein each half is equally fed from a transmitter 5 through a directional coupler or power divider 6 and duplexers 11 and 21 which control whether the apparatus operates in the receive or transmit mode. Preferably, each antenna member 10 and 20 is one-half the total array length consisting of either a linear array waveguide of series fed or corporately fed slots, dipoles or horns, or a full two-dimensional planar array of slots, dipoles, or horns, each element of antenna members 10 and 20 having equal phase. The elements of each antenna member are arranged such that each element is exponentially amplitude fed. It is also preferable that power divider 6 is a 3-dB hybrid junction.

A variable phase shifter 7, preferably a radio frequency phase shifter, is connected between power divider 6 and duplexer 21, phase shifter 7 being operable at either 0°, or nominally 90°, for example, 90°±30°. While phase shifter 7 is illustrated as being connected between power divider 6 and duplexer 21 in FIG. 1, said phase shifter could also be alternatively connected between power divider 6 and duplexer 11, which would reverse the direction of the pattern in FIG. 5.

The subject apparatus 30 of FIG. 1 further includes a pair of mixers 12 and 22 which are connected to, and fed by, duplexers 11 and 21, respectively. Mixers 12 and 22 are also fed by a local oscillator 40. The outputs of mixers 12 and 22 have intermediate frequencies typically in the order of about 30 to 60 mHz. A variable phase shifter 27, operable at either 0°, or nominally 90°, for example, 90°±30°, is connected to mixer 22. Preferably, phase shifter 27 is a low power intermediate frequency phase shifter.

A second directional coupler 50, an intermediate frequency 3-dB hybrid junction, is selectively connectable to a pair of receivers 13 and 23. Directional coupler 50 includes a pair of input ports 1 and 2 and a pair of output ports 3 and 4, output port 3 being a "summation" port, and output port 4 being a "difference" port. More particularly, port 3 provides an output representative of the sum of the signals received from phase shifter 27 and mixer 12, whereas port 4 provides an output representative of the difference between said signals.

A pair of switches 14 and 15 selectively connects the output of mixer 12 to receiver 13 directly, when switches 14 and 15 are in a first position. When the switches are in a second position, the output of mixer 12 is connected to input port 2 of directional coupler 50, and receiver 13 is connected to output port 4 of directional coupler 50.

A second pair of switches 24 and 25 selectively connects the output of phase shifter 27 to receiver 23 directly, when switches 24 and 25 are in a first position. When the switches are in a second position, the output of phase shifter 27 is connected to input port 1 of directional coupler 50, and receiver 23 is connected to output port 3 of directional coupler 50.

In operation, when the apparatus is in the transmit mode and the apparatus components contained within the dotted outline of FIG. 1 are operative, the combined pattern provided by antenna members 10 and 20 is a symmetrical pencil beam pattern, when phase shifter 7 is set at 0°, and a cosecant squared pattern, when phase shifter 7 is set at nominally 90°, for example, 90°±30°.

When the apparatus is in the receive mode, that is, the apparatus components contained within the dashed outline of FIG. 1 are operative, and switches 14 and 15 are connected to conductor 16 and switches 24 and 25 are connected to conductor 26 and phase shifter 27 is set at 0°, receivers 13 and 23 provide an interferometry pattern by comparing the phase of each output signal in, for example, a phase detector. When switches 14 and 24 are connected to input ports 2 and 1, respectively, of directional coupler 50, and switch 15 is connected to "difference" output port 4 of directional coupler 50, and switch 25 is connected to "summation" output port 3 of coupler 50, and phase shifter 27 is set at 0°, a monopulse difference pattern appears at receiver 13 and a symmetrical pencil beam pattern appears at receiver 23. When switches 14, 15, 24 and 25 are again connected to input and output ports 2, 4, 1 and 3, respectively, of directional coupler 50 and phase shifter 27 is set at nominally 90°, for example, 90°±30°, a cosecant squared pattern appears at receiver 23.

Figure 3:
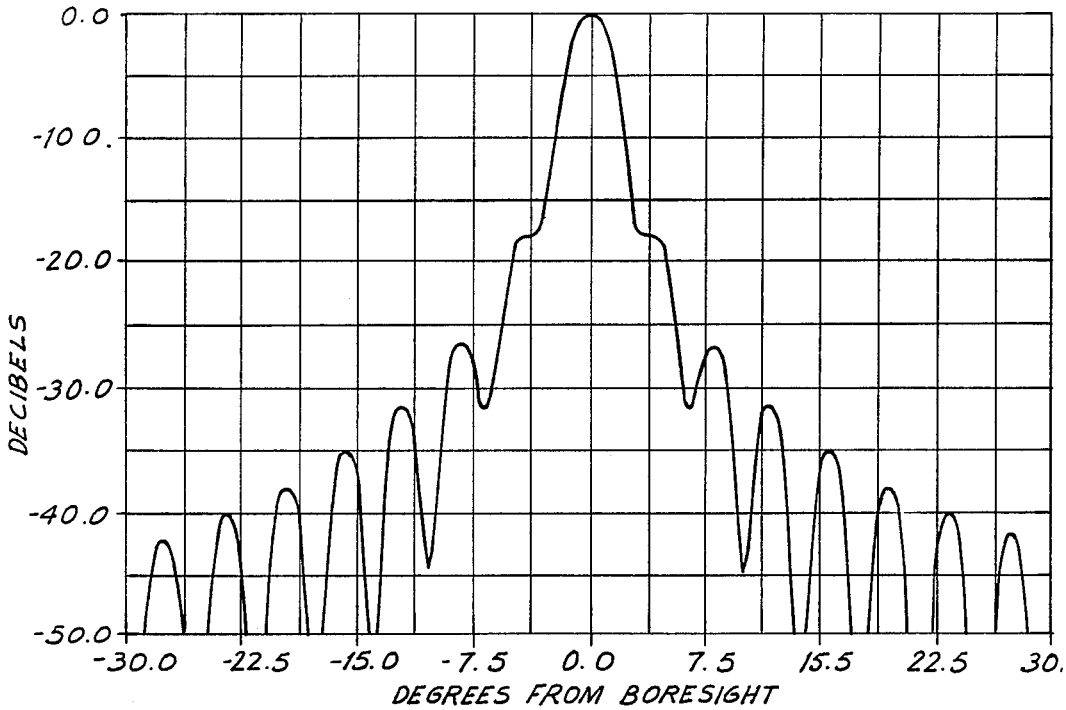
FIG. 3 is a graphical presentation of the adaptive array symmetrical pattern provided by both antenna members of the antenna apparatus of the invention in certain applications.

Mathematical analyses of the subject apparatus under certain specified operating conditions were conducted and computer generated graphs based upon the analyses were obtained. The specific operating conditions are that antenna members 10 and 20 are equally fed and in phase, the elements in each antenna member are exponentially amplitude fed and are in phase, and the antenna apparatus has a 20 dB amplitude taper. FIG. 3 is the computer generated graph of the calculated combined radiation pattern provided by antenna members 10 and 20 when the apparatus is operated under the above conditions and phase shifter 7 set at 0°.

Figure 4:
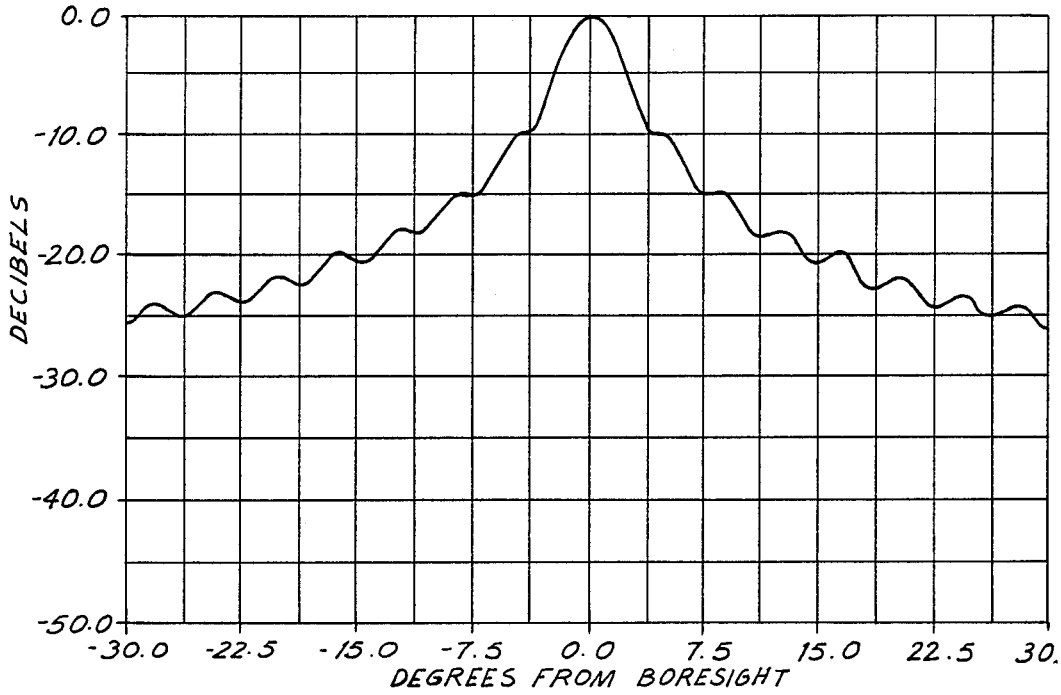
FIG. 4 is a graphical presentation of the adaptive array symmetrical pattern provided by one of the antenna members of the antenna apparatus of the invention in certain applications.

FIG. 4 is a computer generated graph of the calculated radiation pattern provided by either antenna member 10, or antenna member 20, when the subject apparatus is operated under the conditions specified in connection with the graph of FIG. 3. As can be seen, the pattern provided by either antenna member in FIG. 4 is broader than the combined pattern provided by both antenna members in FIG. 3.

Figure 5:
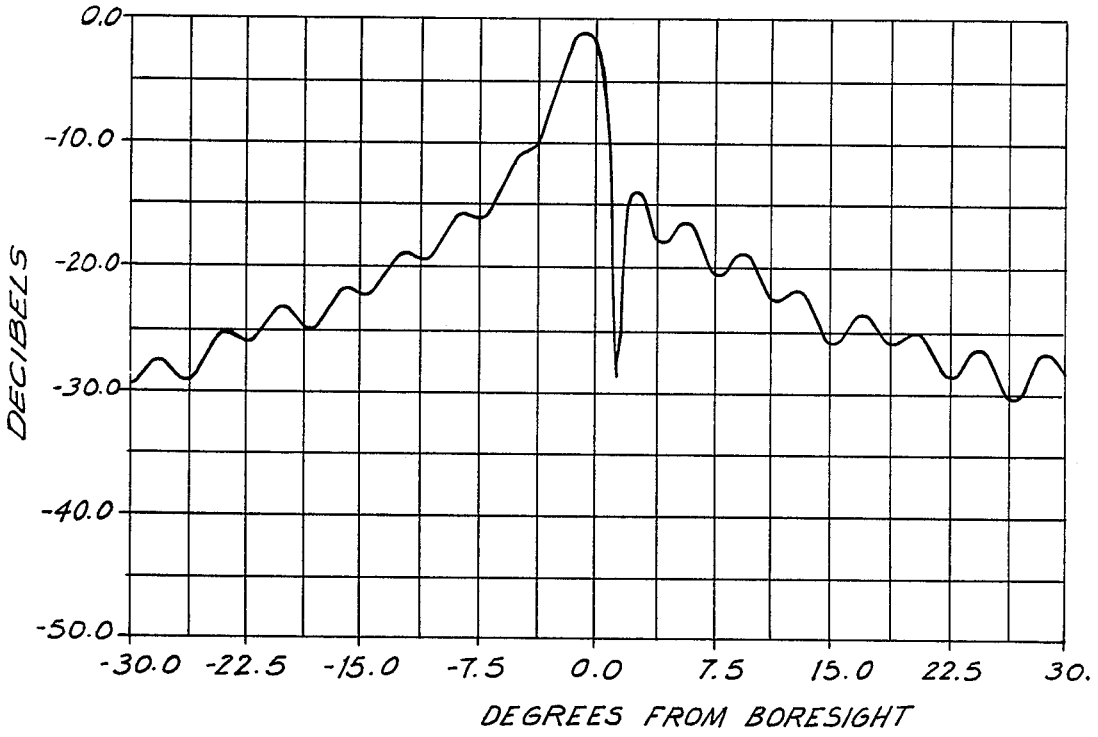
FIG. 5 is a graphical presentation of the adaptive array cosecant squared pattern formed in certain applications of the antenna apparatus of the invention.

FIG. 5 is a computer generated graph of the calculated combined radiation pattern provided by antenna members 10 and 20 when the subject apparatus is operated under the conditions specified in connection with the graph of FIG. 3, except that phase shifter 7 is set at 90°. As illustrated, the pattern generated is a cosecant squared pattern.

It should be noted that while the graphs of FIGS. 3 to 5 illustrate patterns generated by an antenna apparatus having a 20 dB amplitude taper, such a taper is not critical to the invention, but merely an exemplary parameter.

Figure 2:
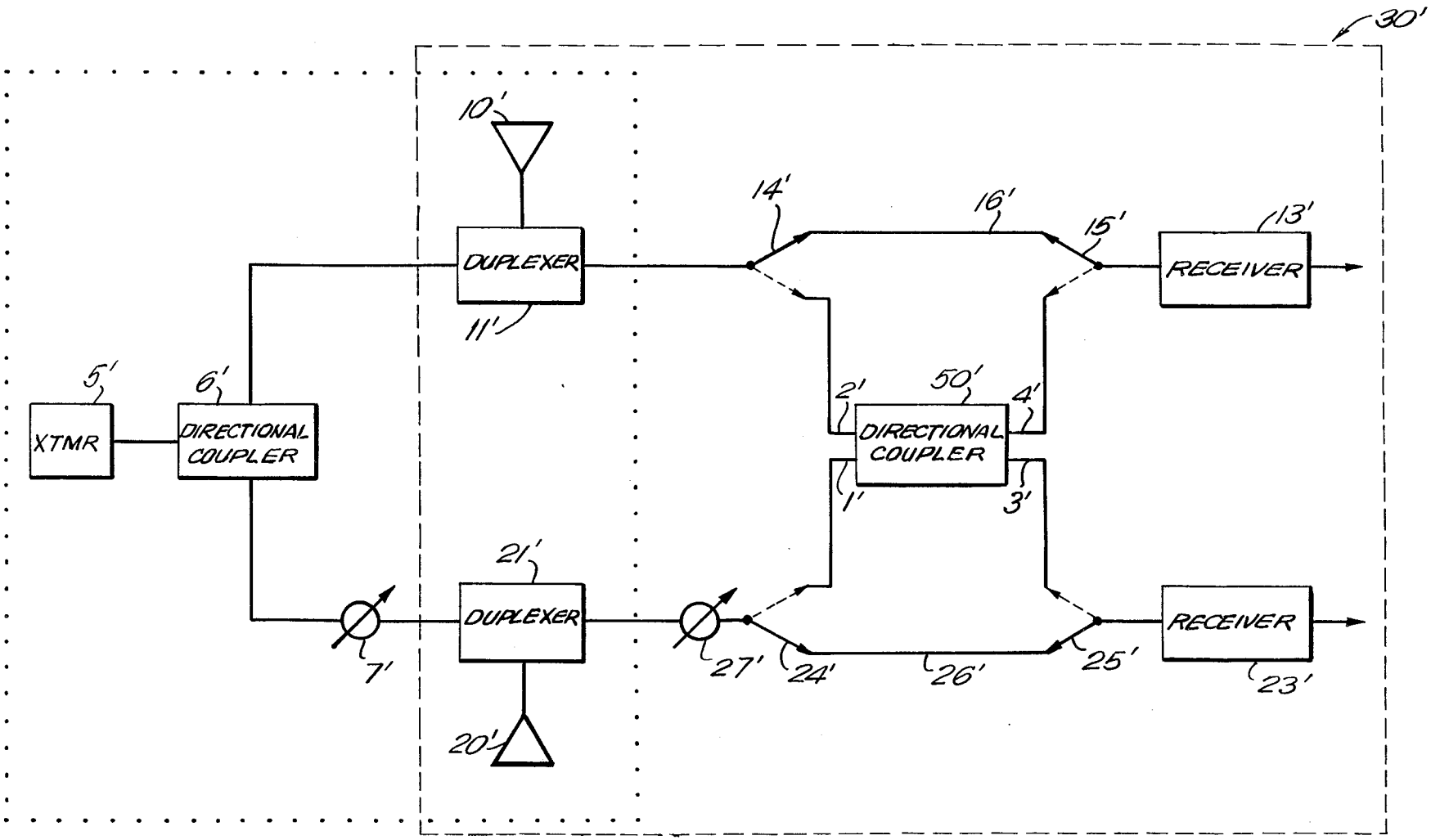
FIG. 2 is a schematic diagram of an alternate embodiment of the antenna apparatus of the invention.

FIG. 2 shows a schematic diagram of an alternate embodiment of the antenna apparatus of the invention. As shown, the apparatus, which is designated generally by reference numeral 30', includes two antenna members 10' and 20' that are equally fed from a transmitter 5' through a directional coupler or power divider 6' and duplexes 11' and 21'. Preferably, each antenna member 10' and 20' is either a linear array waveguide of series fed, or corporately fed slots, dipoles, or horns, or a full two-dimensional planar array of slots, dipoles, or horns, each element of antenna members 10' and 20' being exponentially amplitude fed and having equal phase. It is also preferable that power divider 6' is a 3-dB hybrid junction A variable phase shifter 7', preferably a radio frequency variable phase shifter, is connected between power divider 6' and duplexer 21'. Phase shifter 7' is operable at either 0°, or nominally 90°, for example, 90°±30°. While phase shifter 7' is illustrated as being connected between power divider 6' and duplexer 21' in FIG. 2, said phase shifter could also be alternatively connected between said power divider and duplexer 11', although its nominal number could be changed to maintain original cosecant squared pattern pointing.

A second variable phase shifter 27', operable at either 0°, or nominally 90°, for example, 90°±30°, is also connected to duplexer 21'. Preferably, phase shifter 27' is a radio frequency variable phase shifter. A second directional coupler 50', preferably a radio frequency 3-dB hybrid junction, is selectively connectable to phase shifter 27' and duplexer 11' and also to a pair of receivers 13' and 23'. Directional coupler 50' includes a pair of input ports 1' and 2' and a pair of output ports 3' and 4'. Output port 3' is a "summation" port and output port 4' is a "difference" port. More particularly, port 3' provides an output representative of the sum of the signals received from phase shifter 27' and duplexer 11', whereas port 4' provides an output representative of the difference between said signals. A pair of switches 14' and 15' selectively connects the output of duplexer 11' to receiver 13' directly when switches 14' and 15' are in a first position. When the switches are in a second position, the output of duplexer 11' is connected to input port 2' of directional coupler 50' and receiver 13' is connected to output port 4' of directional coupler 50'.

A second pair of switches 24' and 25' selectively connects the output of phase shifter 27' to receiver 23' directly, when the switches are in a first position. When the switches are in a second position, the output of phase shifter 27' is connected to input port 1' of directional coupler 50', and receiver 23' is connected to output port 3' of directional coupler 50'.

In operation, when apparatus 30' is in the transmit mode and the apparatus components contained within the dotted outline of FIG. 2 are operative, the combined pattern provided by antenna members 10' and 20' is a symmetrical pencil beam pattern, when phase shifter 7' is set at 0°, and a cosecant squared pattern, when phase shifter 7' is set at nominally 90°, for example, 90°±30°. When the apparatus is in the receive mode, that is, the apparatus components contained within the dashed outline of FIG. 2 are operative, and switches 14' and 15' are connected to connector 16', and switches 24' and 25' are connected to connector 26', and phase shifter 27' is set at 0°, receivers 13' and 23' provide an interferometry pattern.

When switches 14' and 24' are connected to input ports 2' and 1', respectively, of directional coupler 50', and switch 15' is connected to "difference" output port 4' of directional coupler 50', and switch 25' is connected to "summation" output port 3' of directional coupler 50', and phase shifter 27' is set at 0°, a monopulse difference pattern appears at receiver 13' and a symmetrical pencil beam pattern appears at receiver 23'. When switches 14', 15', 24' and 25' are connected to input and output ports 2', 4', 1'and 3', respectively, of directional coupler 50' and phase shifter 27' is set at nominally 90°, for example, 90°±30°, a cosecant squared pattern appears at receiver 23'.

In summary, the present invention provides an antenna apparatus having means for rapidly changing the antenna radiation pattern from symmetrical to cosecant squared, to interferometric to monopulse as the application requires without changing the physical configuration of the antenna. The subject apparatus simply switches phase shifters in and out of the RF, and/or in some cases the IF portion of the system, to effect the pattern change very rapidly, for example, in the order of microseconds.

While there has been described above what are at present considered to be the preferred embodiments of the invention, it will be apparent to those of ordinary skill in the art that many and various changes and modifications may be made with respect to the embodiments described and illustrated without departing from the spirit of the invention. It will be understood, therefore, that all such changes and modifications as fall fairly within the scope of the invention, as defined in the appended claims, are to be considered as part of the present invention.

What is claimed is:

1. Antenna apparatus having means for changing the antenna radiation pattern, comprising transmitter means;

first and second antenna members, each antenna member having a plurality of antenna elements which are arranged such that the elements of each antenna member are exponentially amplitude fed;

directional coupler means responsive to said transmitter means for dividing the power from said transmitter means between said first and second antenna members such that each antenna member is provided with a signal of equal amplitude and phase, said directional coupler means consisting of a 3-dB hybrid junction;

radio frequency variable phase shifter means connected between said directional coupler means and one of said antenna members, said variable phase shifter means being selectively operable either at 0° or at a predetermined value in the range of about 60° to 120°; and means for providing a symmetrical pencil beam pattern when said variable phase shifter means is set at 0°, and a cosecant squared pattern when said variable phase shifter means is set at a value in the range of about 60° to 120°.

2. Antenna apparatus having means for changing the antenna radiation pattern, comprising first and second antenna members which are in phase with one another, each antenna member having a plurality of antenna elements which are arranged such that the elements of each antenna member are exponentially amplitude fed;

oscillator means;

first mixer means responsive to said oscillator means and said first antenna member;

second mixer means responsive to said oscillator means and said second antenna member;

intermediate frequency variable phase shifter means responsive to said second mixer means, said variable phase shifter means being selectively operable at either 0° or at a predetermined value in the range of about 60° to 120°;

directional coupler means responsive to said variable phase shifter means and said first mixer means, said directional coupler means having a summation output representative of the sum of the signals received from said first mixer means and said variable phase shifter means, said directional coupler means consisting of a low power intermediate frequency 3-dB hybrid junction; and receiver means responsive to said summation output of said directional coupler means for providing a symmetrical pencil beam pattern when said variable phase shifter means is set at 0°, and a cosecant squared pattern when said variable phase shifter means is set at a value in the range of about 60° to 120°.

3. Antenna apparatus as claimed in claim 2, wherein said directional coupler means includes a difference output representative of the difference between the signals received from said first mixer means and said variable phase shifter means, and wherein said apparatus further comprises second receiver means responsive to said difference output of said directional coupler means for providing a monopulse difference pattern when said variable phase shifter means is set at 0°.

4. Antenna apparatus as claimed in claim 2, wherein said oscillator means is local oscillator means.

5. Radar antenna apparatus having means for changing the antenna radiation pattern, comprising transmitter means;

first and second antenna members, each antenna member having a plurality of antenna elements which are arranged such that the elements of each antenna member are exponentially amplitude fed;

first directional coupler means responsive to said transmitter means for dividing the power from said transmitter means between said first and second antenna members such that each antenna member is provided with a signal of equal amplitude and phase, said first directional coupler means consisting of a radio frequency 3-dB hybrid junction;

first duplexer means connected between said first antenna member and said first directional coupler means;

second duplexer means connected between said second antenna member and said first directional coupler means;

first radio frequency variable phase shifter means connected between said first directional coupler means and said second duplexer means, said first variable phase shifter means being selectively operable either at 0°, or at a predetermined value in the range of about 60° to 120°;

oscillator means;

first mixer means responsive to said oscillator means and said first duplexer means;

second mixer means responsive to said oscillator means and said second duplexer means;

second intermediate frequency variable phase shifter means responsive to said second mixer means, said second variable phase shifter means being selectively operable at either 0° or a predetermined value in the range of about 60° to 120°;

second directional coupler means responsive to said second variable phase shifter means and said first mixer means, said second directional coupler means having a summation output representative of the sum of the signals received from said first mixer means and said second variable phase shifter means, said second directional coupler means consisting of a low power intermediate frequency 3-dB hybrid junction; and receiver means responsive to said summation output of said second directional coupler means for providing a symmetrical pencil beam pattern when said second variable phase shifter means is set at 0° and a cosecant squared pattern when said second variable phase shifter means is set at a value in the range of about 60° to 120°.

6. Radar antenna apparatus as claimed in claim 5, wherein said second directional coupler means includes a difference output representative of the difference between the signals received from said first mixer means and said second variable phase shifter means, and wherein the apparatus further comprises second receiver means responsive to said difference output of said second directional coupler means for providing a monopulse difference pattern when said second variable phase shifter means is set at 0°.

7. Radar antenna apparatus having means for changing the antenna radiation pattern, comprising transmitter means;

first and second antenna members, each antenna member having a plurality of antenna elements which are arranged such that the elements of each antenna member are exponentially amplitude fed;

first directional coupler means responsive to said transmitter means for dividing the power from said transmitter means between said first and second antenna members such that each antenna member is provided with a signal of equal amplitude and phase, said first directional coupler means consisting of a radio frequency 3-dB hybrid junction;

first duplexer means connected between said first antenna member and said first directional coupler means;

second duplexer means connected between said second antenna member and said first directional coupler means;

first radio frequency variable phase shifter means connected between said first directional coupler means and said second duplexer means, said first variable phase shifter means being selectively operable either at 0°, or at a predetermined value in the range of about 60° to 120°;

oscillator means;

first mixer means responsive to said oscillator means and said first duplexer means;

second mixer means responsive to said oscillator means and said second duplexer means;

second intermediate frequency variable phase shifter means responsive to said second mixer means, said second variable phase shifter means being selectively operable at either 0° or a predetermined value in the range of about 60° 120°;

second directional coupler means responsive to said second variable phase shifter means and said first mixer means, said second directional coupler means having a pair of input ports, a summation port for providing an output representative of the sum of the signals received from said first mixer means and said second variable phase shifter means, and a difference port for providing an output representative of the difference between the signals received from said first mixer means and said second variable phase shifter means, said second directional coupler means consisting of a low power intermediate frequency 3-dB hybrid junction first and second receiver members;

a first pair of switches, one of said switches being connected to said first receiver means, said switches each having a first and second position such that when said switches are in the first position said first mixer means is connected to said first receiver means and when said switches are in the second position said first mixer means is connected to one of the input ports of said second directional coupler means and said first receiver means is connected to the difference output port of said second directional coupler means; and a second pair of switches, one of the switches in said second pair being connected to said second variable phase shifter means, the other switch in said second pair of switches being connected to said second receiver means, said switches in said second pair of switches each having a first and second position such that when said second pair of switches is in its first position said second variable phase shifter means is connected to said second receiver means and when said second pair of switches is in its second position said second variable phase shifter means is connected to the other input port of said second directional coupler means and said second receiver means is connected to the summation output port of said second directional coupler means.

8. Radar antenna apparatus having means for changing the antenna radiation pattern, comprising first and second antenna members which are in phase with one another, each antenna member having a plurality of antenna elements which are arranged such that the elements of each antenna member are exponentially amplitude fed;

radio frequency variable phase shifter means responsive to said second antenna member, said variable phase shifter means being selectively operable at 0°, or a predetermined value in the range of about 60° to 120°;

directional coupler means responsive to said variable phase shifter means and said first antenna member, said directional coupler means having a summation output representative of the sum of the signals received from said first antenna member and said variable phase shifter means, said directional coupler means consisting of a radio frequency 3-dB hybrid junction; and receiver means responsive to said summation output of said directional coupler means for providing a symmetrical pencil beam pattern and an interferometry pattern when said variable phase shifter means is set at 0°, and a cosecant squared pattern when said variable phase shifter means is set at a value in the range of about 60° to 120°.

9. Radar antenna apparatus as claimed in claim 8, wherein said directional coupler means includes a difference output representative of the difference between the signals received from said first antenna member and said variable phase shifter means, and wherein said apparatus further comprises second receiver means responsive to said difference output of said directional coupler means for providing a monopulse difference pattern when said variable phase shifter means is set at 0°.

10. Radar antenna apparatus having means for changing the antenna radiation pattern, comprising transmitter means;

first and second antenna members, each antenna member having a plurality of antenna elements which are arranged such that the elements of each antenna member are exponentially amplitude fed;

first directional coupler means responsive to said transmitter means for dividing the power from said transmitter means between said first and second antenna members such that each antenna member is provided with a signal of equal amplitude and phase, said first directional coupler means consisting of a radio frequency 3-dB hybrid junction;

first duplexer means connected between said first antenna member and said first directional coupler means;

second duplexer means connected between said second antenna member and said first directional coupler means;

first radio frequency variable phase shifter means connected between said first directional coupler means and said second duplexer means, said first variable phase shifter means being selectively operable either at 0°, or at a predetermined value in the range of about 60° to 120°;

second radio frequency variable phase shifter means responsive to said second duplexer means, said second variable phase shifter means being selectively operable either at 0°, or a predetermined value in the range of about 60° to 120°;

second directional coupler means responsive to said second variable phase shifter means and said first duplexer means, said second directional coupler means having a summation output representative of the sum of the signals received from said first duplexer means and said second variable phase shifter means, said second directional coupler means consisting of a radio frequency 3-dB hybrid junction; and receiver means responsive to said summation output of said second directional coupler means for providing a symmetrical pencil beam pattern when said second variable phase shifter means is set at 0°, and a cosecant squared pattern when said second variable phase shifter means is set at a value in the range of about 60° to 120°.

11. Radar antenna apparatus as claimed in claim 10, wherein said second directional coupler means includes a difference output representative of the difference between the signals received from said first duplexer means and said second variable phase shifter means, and wherein said apparatus further comprises second receiver means responsive to said difference output of said second directional coupler means for providing a monopulse difference pattern when said variable phase shifter means is set at 0°.

12. Radar antenna apparatus having means for changing the antenna radiation pattern, comprising transmitter means;

first and second antenna members, each antenna member having a plurality of antenna elements which are arranged such that the elements of each antenna member are exponentially amplitude fed;

first directional coupler means responsive to said transmitter means for dividing the power from said transmitter means between said first and second antenna members such that each antenna member is provided with a signal of equal amplitude and phase, said first directional coupler means consisting of a radio frequency 3-dB hybrid junction;

first duplexer means connected between said first antenna member and said first directional coupler means;

second duplexer means connected between said second antenna member and said first directional coupler means;

first radio frequency variable phase shifter means connected between said first directional coupler means and said second duplexer means, said first variable phase shifter means being selectively operable either at 0° or at a predetermined value in the range of about 60° to 120°;

second radio frequency variable phase shifter means responsive to said second duplexer means, said second variable phase shifter means being selectively operable either at 0°, or a predetermined value in the range of about 60° to 120°:

second directional coupler means responsive to said second variable phase shifter means and said first duplexer means, said second directional coupler means having a pair of input ports, a summation output port for providing an output representative of the sum of the signals received from said first duplexer means and said second variable phase shifter means, and a difference output port for providing an output representative of the difference between the signals received from said first duplexer means and said second variable phase shifter means, said second directional coupler means consisting of a radio frequency 3-dB hybrid junction;

first and second receiver members;

a first pair of switches, one of said switches being connected to said first duplexer means the other switch being connected to said first receiver means, said switches each having a first and second position such that when said switches are in the first position, said first duplexer means is connected to said first receiver means, and when said switches are in the second position said first duplexer means is connected to one of the input ports of said second directional coupler means and said first receiver means is connected to the difference output port of said second directional coupler means; and a second pair of switches, one of the switches in said second pair being connected to said second variable phase shifter means, the other switch in said second pair of switches being connected to said second receiver means, said switches in said second pair of switches each having a first and second position such that when said second pair of switches is in its first position said second variable phase shifter means is connected to said second receiver means and when said second pair of switches is in its second position said second variable phase shifter means is connected to the other input port of said second directional coupler means and said second receiver means is connected to the summation output port of said second directional coupler means.

* * * * *